US007351155B2

(12) United States Patent
Lickle

(10) Patent No.: US 7,351,155 B2
(45) Date of Patent: Apr. 1, 2008

(54) HALF PIPE HARNESS SAFETY SYSTEM

(76) Inventor: Brett Lickle, 12-A Mamao Pl., Haiku, HI (US) 96708

( * ) Notice: Subject to any disclaimer, the term of this patent is extended or adjusted under 35 U.S.C. 154(b) by 5 days.

(21) Appl. No.: 11/430,719

(22) Filed: May 9, 2006

(65) Prior Publication Data

US 2007/0021225 A1 Jan. 25, 2007

Related U.S. Application Data

(60) Provisional application No. 60/710,326, filed on Aug. 22, 2005, provisional application No. 60/686,209, filed on Jun. 1, 2005, provisional application No. 60/679,208, filed on May 9, 2005.

(51) Int. Cl.
*A63C 19/10* (2006.01)

(52) U.S. Cl. ..... 472/89; 472/133; 482/69; 103/113

(58) Field of Classification Search ..... 472/133, 472/89; 482/69, 71; 104/113
See application file for complete search history.

(56) References Cited

U.S. PATENT DOCUMENTS 1,859,180 A * 5/1932 Thiel ..... 104/113
2,478,004 A * 8/1949 Newell ..... 482/69
3,861,318 A * 1/1975 Massa ..... 104/113
4,410,175 A * 10/1983 Shamp ..... 482/69
4,545,575 A * 10/1985 Forjot ..... 482/69
5,403,253 A 4/1995 Gaylord
5,524,310 A * 6/1996 Farnen ..... 14/69.5
5,613,926 A 3/1997 Michaelson
6,302,828 B1 10/2001 Martin et al.
6,436,009 B1 8/2002 Marucci
6,554,747 B1 * 4/2003 Rempe ..... 482/38
2002/0020582 A1 2/2002 Boyer
2002/0046903 A1 4/2002 Strickler
2002/0065173 A1 5/2002 Cook
2002/0084140 A1 7/2002 Lee
2003/0018287 A1 1/2003 Gilliam
2005/0023779 A1 2/2005 Kalvelage
2005/0026757 A1 2/2005 Creary

* cited by examiner

*Primary Examiner*—Kien Nguyen
(74) *Attorney, Agent, or Firm*—McCarter & English

(57) ABSTRACT

The invention relates to a harness safety system that can be used while riding, for example, a skateboard, a bike, rollerblades, etc. through a half pipe. Specifically, the invention comprises a track spanning the half-pipe having a free-running cord and harness hanging therefrom that allows the rider to proceed through the flats and up the transitions of a half pipe while retaining tension on the rider throughout the process and arresting the rider's fall, thus preventing the rider from serious injury.

10 Claims, 7 Drawing Sheets

HALF PIPE HARNESS SAFETY SYSTEM

CROSS REFERENCE TO RELATED APPLICATIONS

This application claims the benefit of U.S. Provisional Application No. 60/679,208, filed May 9, 2005 and U.S. Provisional Application No. 60/686,209, filed Jun. 1, 2005 and U.S. Provisional Application No. 60/710,326, filed Aug. 22, 2005 the contents of which are incorporated herein by reference.

FIELD OF THE INVENTION

The present invention relates to a harness safety system to be used while riding, for example, a skateboard through a half pipe. More particularly, the invention relates to a harness safety system that allows such a rider of a skateboard to proceed through the flats and up the transitions of a half pipe while retaining tension on the rider throughout the process.

BACKGROUND OF THE INVENTION

The use of the half pipe is emerging as an integral part of such activities as skateboarding, snowboarding, biking and rollerblading. In general terms, the half pipe is a U-shaped deck having a flat base with upward transitioning walls on either side to form the shape of a U. In use, a rider will ride his device up one transition wall then down the wall into and through the flats and then up the other transition wall. The process repeats itself as the rider goes back and forth, up and down through the U. As riders improve their skills in the half pipe, they begin to incorporate tricks into the ride. For example, when a rider has generated enough speed or momentum to reach and overcome the top of the transition walls, he can do tricks in the air and land back on the downward slope of the transition wall and ride back down into the flats of the half-pipe. Tricks would include anything from a simple turn of the device in the air, to multiple flips and spins in the air. The challenge is not only in being able to do the trick in the air, but also to be able to land back on the transition wall and continue riding on the device back through the half-pipe to the other side.

Riding the half pipe clearly is a dangerous endeavor. A fall from the walls of the half pipe can cause serious injury to a rider. In fact, many beginners are afraid to attempt the half pipe at all after they fall once or twice. In addition, many experienced riders are afraid to attempt some tricks for fear of getting seriously injured. As with any endeavor, in order to master it, practice is essential. Practicing on the half pipe, however, will inevitably lead to a fall and injury, and as a result, many will lose the confidence to attempt such a stunt again, regardless of the difficulty level, for fear of getting hurt.

In order to ease the learning process of learning to ride in the half pipe, there is a need for a system that allows a rider the ability to freely ride in the half pipe and attempt tricks without the fear or concern of falling hard or getting injured.

SUMMARY OF THE INVENTION

The invention is directed to a half-pipe safety system comprising:

A. a half-pipe shaped surface comprising a flat base and first and second transition walls wherein said first transition wall terminates at a first platform and said second transition wall terminates at a second platform;

B. a track disposed above said surface and extending horizontally from a position above said first platform to a position above said second platform;

C. a fastener disposed on said track and adapted to ride freely along said track;

D. a cord comprising a top end and a bottom end wherein said top end is fixedly attached to said fastener; and E. a harnessing apparatus fixedly attached to the bottom end of said cord.

The invention is further directed to the half-pipe safety system set forth above further including first and second stoppers movably disposed on said track, said first stopper positioned between said fastener and said position above the first platform, and said second stopper positioned between said fastener and said position above the second platform, and each of said first and second stoppers adapted to be fixed in a predetermined position on said track.

BRIEF DESCRIPTION OF THE DRAWINGS

FIG. 6 depicts a full course set up wherein the rider is attached to a side-to-side cable that is in turn attached to left and right running cables that extend along the sides of the course, wherein the course comprises various obstacles and trick apparatuses over which the rider rides through.

DETAILED DESCRIPTION OF THE INVENTION

The present invention is directed to a half-pipe safety system designed to allow riders of skateboards, snowboards, bicycles, rollerblades, etc. to ride the half pipe without the consequences of falling and hurting themselves, while not inhibiting riders from practicing new maneuvers and pushing their riding skills to the next level.

Half-Pipe

Figure 1:
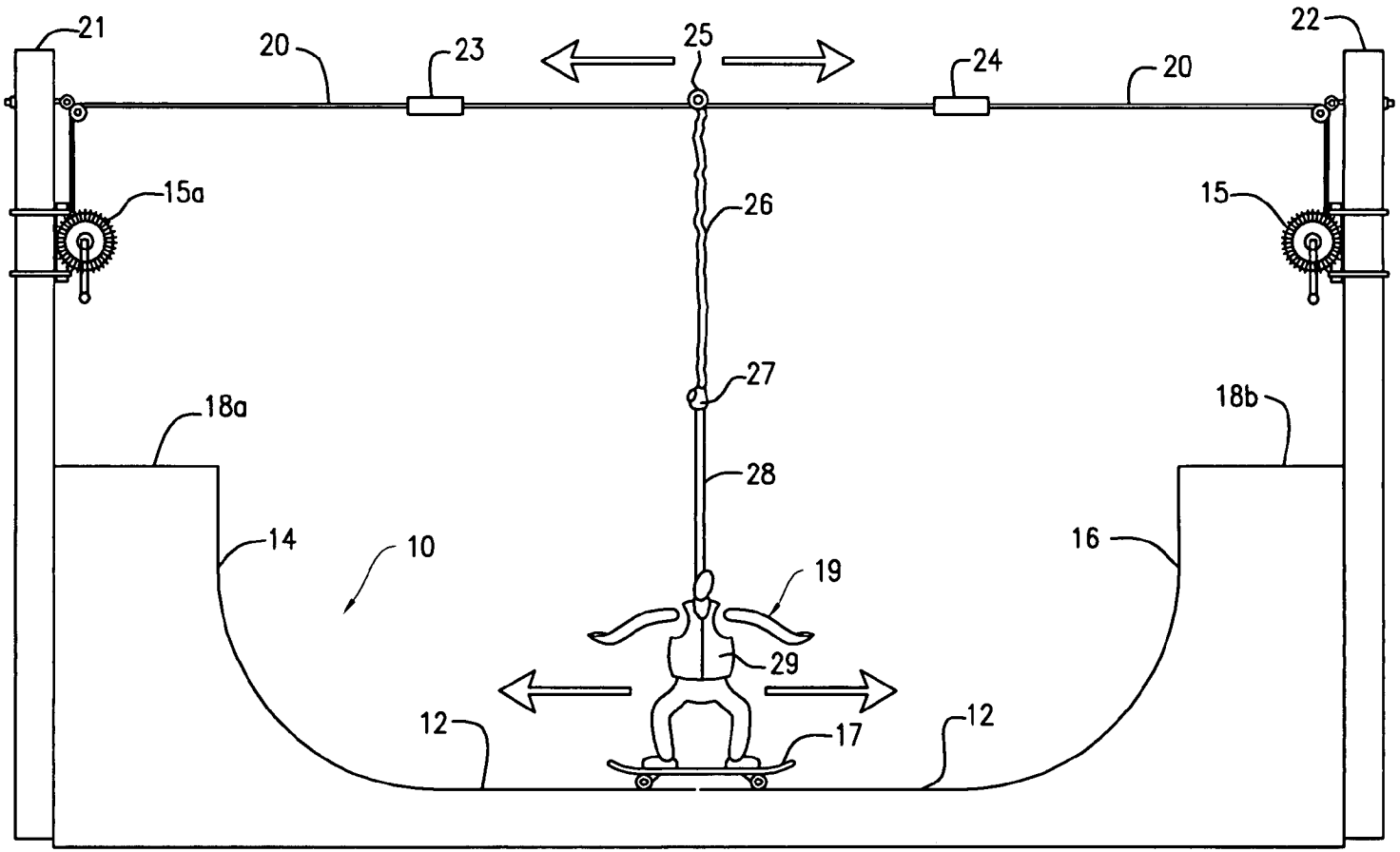
FIG. 1 is a depiction of one embodiment of the invention showing a skateboard rider in a half-pipe wherein the rider is wearing a harness attached to a bungee cord which in turn is attached to a pulley that rides along a cable extending above said half-pipe.

The half-pipe is a popular surface used by skateboarders, bikers, snowboarders, roller-bladers, etc. The use of half-pipes in the competitive setting for most of these sports may be recognized, for example, from its use in the annual X-Games. The half-pipe generally consists of a half-pipe or U-shaped surface that has a flat base forming the bottom of the "U", and two upward transition walls on each side of the flat base forming the sides of the "U". At the top of one or each of the transition walls is a platform from where the rider can start and finish their ride. One embodiment of a halfpipe is depicted in FIG. 1. In an example of a ride through a half-pipe, the rider 19 can start on one platform 18*a*, ride down a first transition wall 14 through the flats 12 and up the opposite transition wall 16; then back down transition wall 16 back through the flats 12 and up the first transition wall 14. The process can be repeated as many times as a rider wants. Once this process is mastered, riders then begin to ride up and through the pinnacle of either transition wall 14, 16 into the air, landing back on the downward slope of that transition wall. While in the air, riders can perform various tricks such as twists, turns and flips.

Safety System

The safety system of the invention can be viewed in one embodiment wherein the safety system is set up with the standard half-pipe shown in FIG. 1. The half-pipe 10 comprises a flat base 12, a left transition wall 14, a right transition wall 16, a left platform 18*a* and a right platform 18*b*. In a preferred embodiment, disposed at the left and right ends of the platforms 18*a* and 18*b* are poles 21 and 22. Extending horizontally between the poles 21 and 22 is a track 20 having a movable fastener 25 riding thereon. Optionally attached to the track 20 can be two is stoppers 23, 24 that are adapted to retain the fastener 25 therebetween, thus retaining fastener 25 within a confined area along the track 20.

The track 20 can comprise a variety of materials. In a preferred embodiment, track 20 comprises cable or cable wire. Alternatively, however, any solid piece of material such as aluminum, steel, fiberglass or any other material along which a fastener 25 can ride can be used. Basically, any material that can satisfactorily retain the weight of a rider without breaking and otherwise function in accordance with the invention would be suitable to be used as the track 20. In an alternate embodiment, it is contemplated that the track 20 comprise a solid piece or pieces of material that follow the contours of the half-pipe so that the harness follows a perfect arch giving the rider the smoothest ride. In other words, track 20 would be shaped as a "U" above the half-pipe.

Fastener 25 should be able to freely move or ride along track 20. Non-limiting examples of such a moving fastener would include a pulley (i.e. for use on a cable) or a roller (i.e. for use on a solid track).

Stoppers 23, 24 are an optional feature of the invention that used to confine the section of the track 20 along which the fastener 25 can run. Stoppers 23 and 24 are adapted to be temporarily movable along the track 20, but should also be adapted to be tightened into a fixed position, and should be further adapted to stop and hold the fastener 25 while a rider continues to move in that direction and up the transition wall. Once the rider comes down the transition wall and past the stopper, the fastener will then move in the opposite direction. Materials that can be used as the stoppers could include, for example, a clamp and spring which would preferably be surrounded by a soft material thus cushioning the repetitive contact with the fastener 25.

Attached to said fastener 25 is a cord 26. At the opposite end of the cord 26 is attached a harnessing device 29. It is preferred that the cord 26 be made of a flexible material such as a bungee cord. In the embodiment depicted in FIG. 1, a clip 27 is attached to the far end of the cord 26 and attached to the clip 27 is a second cord 28 which is attached to the harnessing device 29. The second cord 28 is preferably made of a material stiffer than the material used for cord 26 and is used to help avoid potential injury that could occur with a more flexible cord, such as the flexible cord 26 wrapping around the rider's neck. Some examples of material suitable for use in the second, stiffer cord 28 would include rubber, plastic, or vinyl, among others.

As mentioned above, at the end of the cord 26 (opposite the end attached to fastener 25) is attached a harnessing apparatus 29. The harnessing apparatus 29 is adapted to be worn by the rider 19 during use of the safety system of the invention. The cord 26 is preferably fixedly attached to the harnessing apparatus 29 by a nature that will allow the rider perform all phases of riding, allowing the rider to freely perform any trick desired, including twists, turns and flips without hindrance from the harness 29 or the cord 26. While it is preferred that the cord 26 is attached to the portion of the harness 29, cord 26 can be attached to any portion of harness 26 that allows the rider freedom of movement as desired. If less movement is desired a more secure attachment, or perhaps multiple attachments can be used The system of the invention works by allowing the rider 19 to move through the flats 12 of the half pipe 10 while the fastener 25 moves along the track 20 with rider 19 until the fastener 25 abuts against the stopper 23, 24. The stoppage of the fastener 25 at that point allows the rider 19 to proceed up the transition wall 14, 16 while tension is kept on the rider's harness 29. It is preferred that the stoppers 23, 24 are disposed at a predetermined position such that the fastener 25 is stopped at approximately the same point where the rider 19 begins to proceed up the transition wall of the half-pipe. In alternative embodiments, by moving the stoppers 23, 24 further away from each other, the degree of difficulty is increased and range of motion is extended when the rider moves along the transition walls. Alternatively, range of motion can also be increased by lowering the harness 29 closer to the ground.

The height of track 20 is preferably adjustable to suit any sized rider 19. The length of cord 26 and/or the combination of flexible cord 26 and stiff cord 28 are also preferably adjustable. As such, it is a function of the invention that the height of track 20 and the length of cord 26 be adjusted so that, while wearing the harness 29, a rider 19 can ride a skateboard, bike or other device freely in the normal fashion, while enough tension is provided such that if the rider 19 falls, the fall is arrested prior to the rider 19 hitting the surface or avoiding injury from a fall. While the length of cord 26 and/or the height of the track 20 will vary depending upon the device the rider is riding (i.e. bicycle vs. skateboard) or the height of the rider, the general rule of thumb is that, without the device present, the tension should be such that the rider, while wearing the harness 29, should be hanging above the base 12 such that he can only touch his toes on the surface. This distance will generally allow the rider to comfortably ride the device while also being safe from injury from a fall.

There is no limitation on the length of track 20, so long as it traverses the entire width of the half-pipe. There is no limit to the height or width of the half-pipe so long as the track is disposed above it.

It is envisioned that the present invention will be suitable for use in a variety of settings, including, for example, back yard half pipes, skateboard parks, mobile half pipes, skate and surf events, amusement parks and zoos.

Track Set Up

Figure 2:
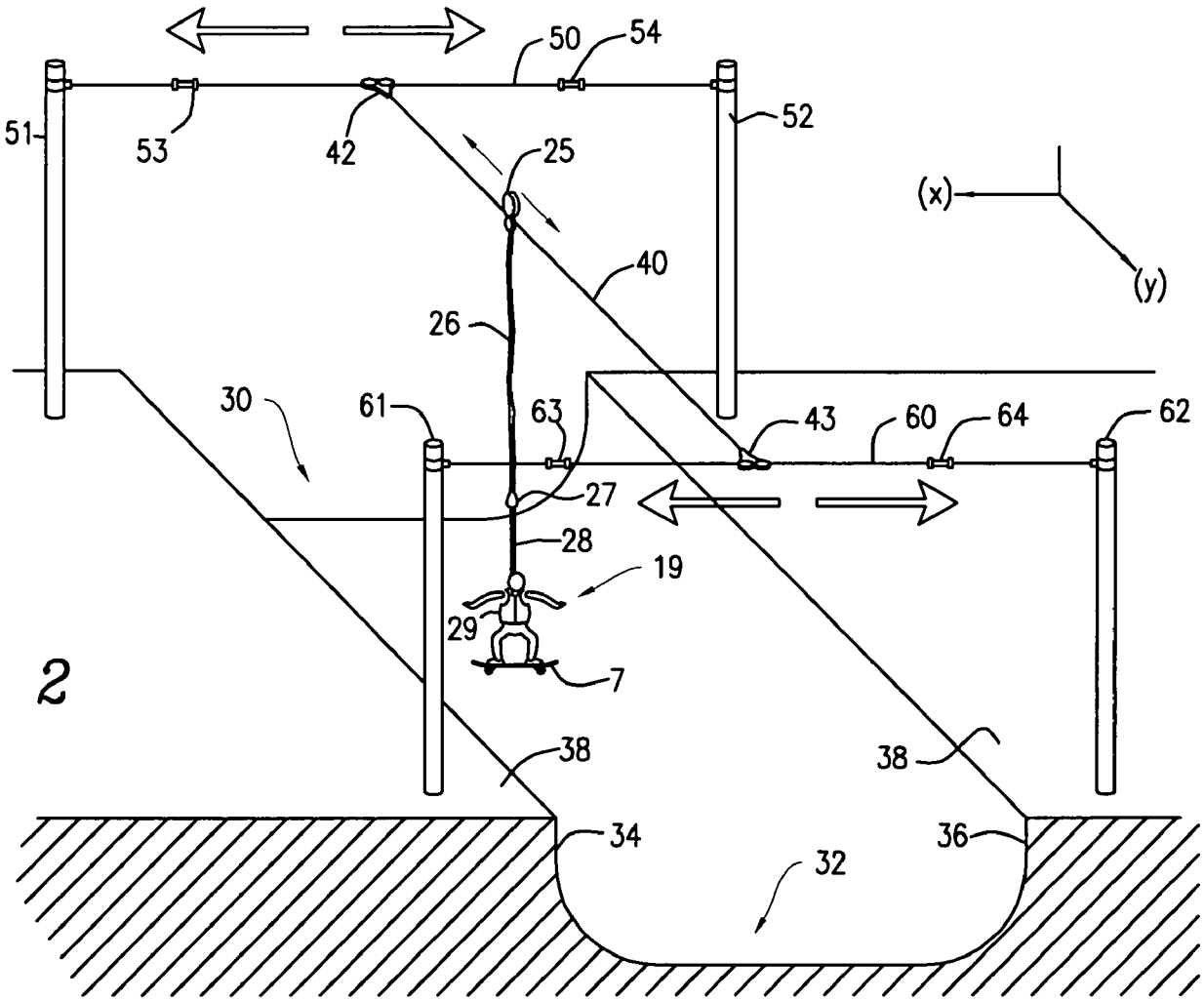
FIG. 2 is a depiction of an alternate embodiment of the invention showing a snowboard rider in a downhill half-pipe wherein the rider's harness is attached to a single running cable which in turn is attached to two side-to-side cables disposed at each end of the half-pipe.
Figure 3:
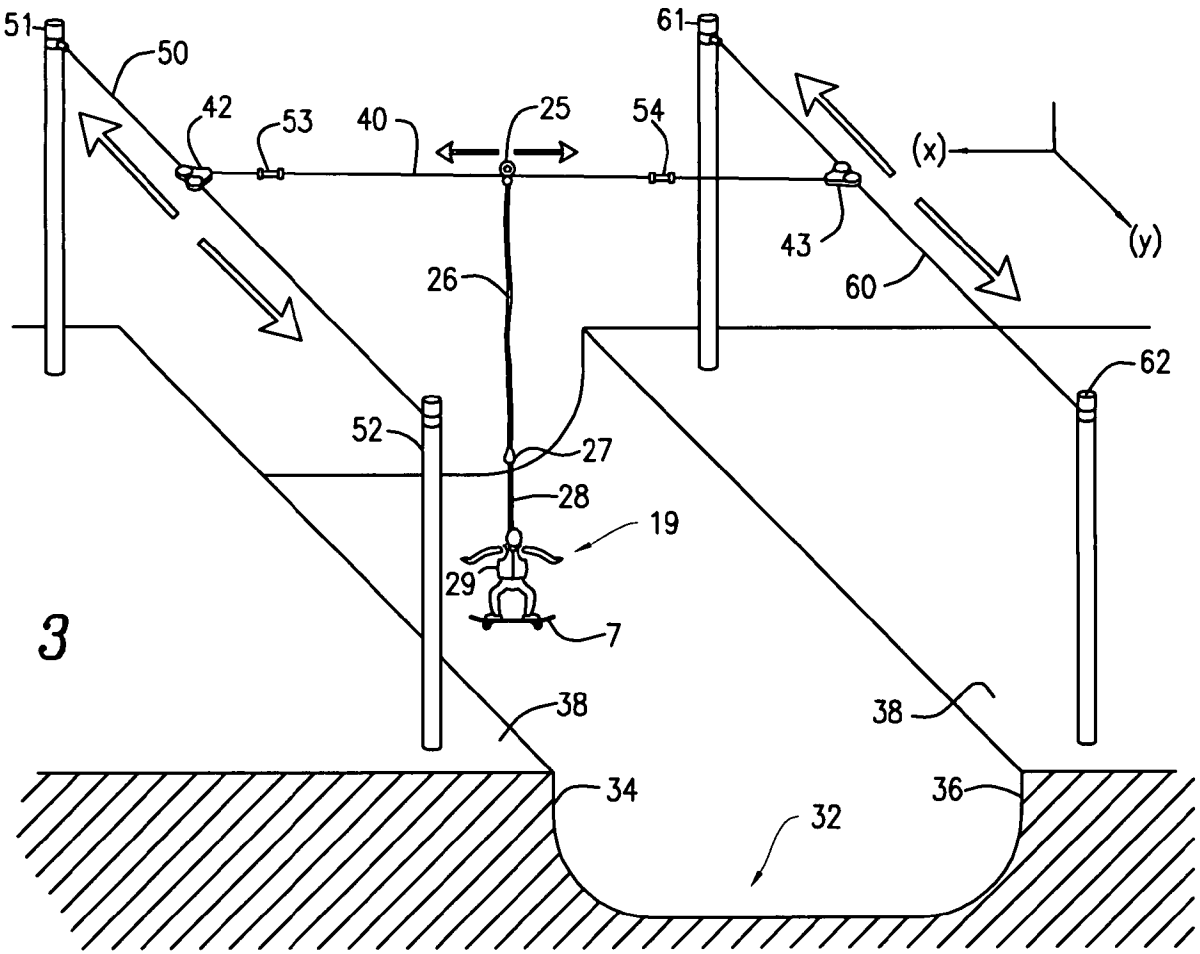
FIG. 3 is a depiction of an alternate embodiment of the invention showing a snowboard rider in a downhill half-pipe wherein the rider's harness is attached to a single side-to-side cable which in turn is attached to two running cables disposed along each side of the half-pipe.
Figure 4:
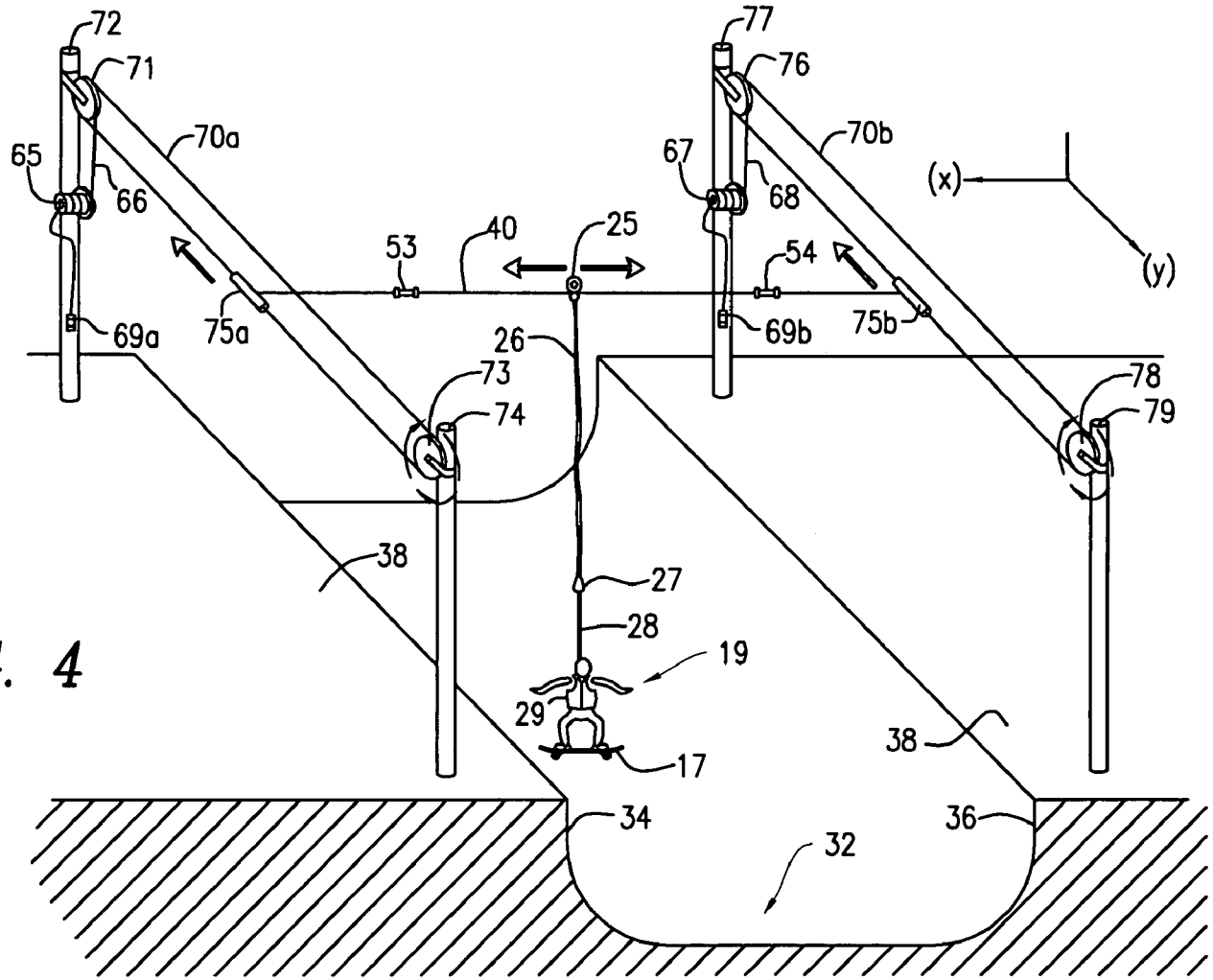
FIG. 4 is a variation of the embodiment shown in FIG. 3 wherein the two running cables are controlled by a motorized winding system that not only controls the rate of the rider going downhill, but also returns the rider back to the start position at the top of the downhill when finished.

In certain embodiments of this invention, the system can be set up on a half pipe with either the tracking running along the length of the half pipe or the width of the half-pipe as depicted in FIGS. 2-4. This embodiment is depicted in the figures on a downhill half-pipe set up which is a common set up for riding a snowboard, and in fact is quite commonly used competitively in the sport of snowboarding. However, the safety system of the invention is applicable to traditional half-pipe set-ups, or any other half-pipe construction. In the embodiment depicted in FIG. 2, the safety system of the invention comprises two tracks 50 and 60, track 50 disposed at the upper end and track 60 at the lower end of the downhill half-pipe. In this particular embodiment, tracks 50 and 60 traverse the half-pipe laterally and are preferably held in place by poles 51, 52 and 61, 62 respectively. Extending laterally between tracks 50 and 60 is a third track 40. Track 40 is the track to which the rider 19 will be attached via cord 26. Track 40 extends longitudinally along the length of the half-pipe wherein the upper end of track 40 is attached to track 50 via fastener 42 which is freely movable along track 50 until it abuts against stoppers 53 and 54 and the lower end of track 40 is attached to track 60 via fastener 43 in preferably the same fashion. As such, in this embodiment, as the rider 19 moves longitudinally through the half-pipe, fastener 25 moves down track 40. As the rider 19 moves laterally up and down the walls 34, 36 of the half-pipe, track 40 moves laterally along tracks 50 and 60 until the fasteners 42 and 43 abut against respective the stoppers 53 and 63 or 54 and 64. It is preferred that the distance between stoppers 53 and 54 be approximately the same as the distance between stoppers 63 and 64, and it is also preferred that they be disposed are approximately equivalent positions over the respective transition walls.

An alternative embodiment for the downhill half-pipe is depicted in FIG. 3. In this embodiment, track 40 is disposed laterally across the half-pipe, instead of longitudinally as depicted in FIG. 2. Tracks 50 and 60 are disposed longitudinally along the length of the half-pipe with track 40 disposed therebetween. Track 40 is attached to tracks 50 and 60 via free riding fasteners 42 and 43 respectively. In this set up, the stoppers 53 and 54 are disposed on track 40. The rider 19 moves laterally through the half-pipe along track 40 while track 40 moves longitudinally down the length of the half-pipe via tracks 50 and 60.

FIG. 4 depicts yet another embodiment of the safety system in use on a downhill half-pipe. This embodiment is set up similar to that shown in FIG. 3 in that track 40 from which the rider hangs is disposed laterally across the half-pipe. This embodiment, however, is designed to control the rate at which the rider traverses the half-pipe by having track 40 fixedly attached to the longitudinal tracks 70*a* and 70*b* wherein tracks 70*a* and 70*b* are motorized or otherwise driven to move up and down the length of the half-pipe, by, for example, a pulley system similar to a chair lift system used at a ski resort. As mentioned above, this embodiment not only controls the rate of traversal down the pipe, but also returns the rider to the top for another run.

The embodiments shown in FIGS. 2-4 could be used to create the first ever downhill skateboard-bicycle-rollerblade half pipe. The downhill half pipe harness system is designed to allow a rider to ride the newest and most extreme aspects of half pipe riding the downhill half pipe. This downhill set up allows the rider to move down hill through the half pipe similar to a snowboard half pipe only there is no snow. As the rider proceeds through the half pipe, he can perform maneuvers on his skateboard similar to those of snow boarding, with or without straps or bindings. The size of the half pipe can be anything from a one hit wonder to a full size Olympic half pipe and even bigger if desired.

Multi-directional Set-up

In this embodiment, the system of the invention is set up to function in multidirectional fashion. For example, in one embodiment, the multi-directional system would include a three pulley system. In a single pulley system the rider is limited to how far he can go side to side or laterally on the half-pipe. In a three pulley system, there would be two pulleys tracking longitudinally or end to end and a third pulley at the same time tracking laterally or side to side. This gives the rider the ability to ride the entire half-pipe. The set up is different in that it now would require poles on all four corners with a track on either side running the length of the half pipe.

Full Course Set Up

Figure 5:
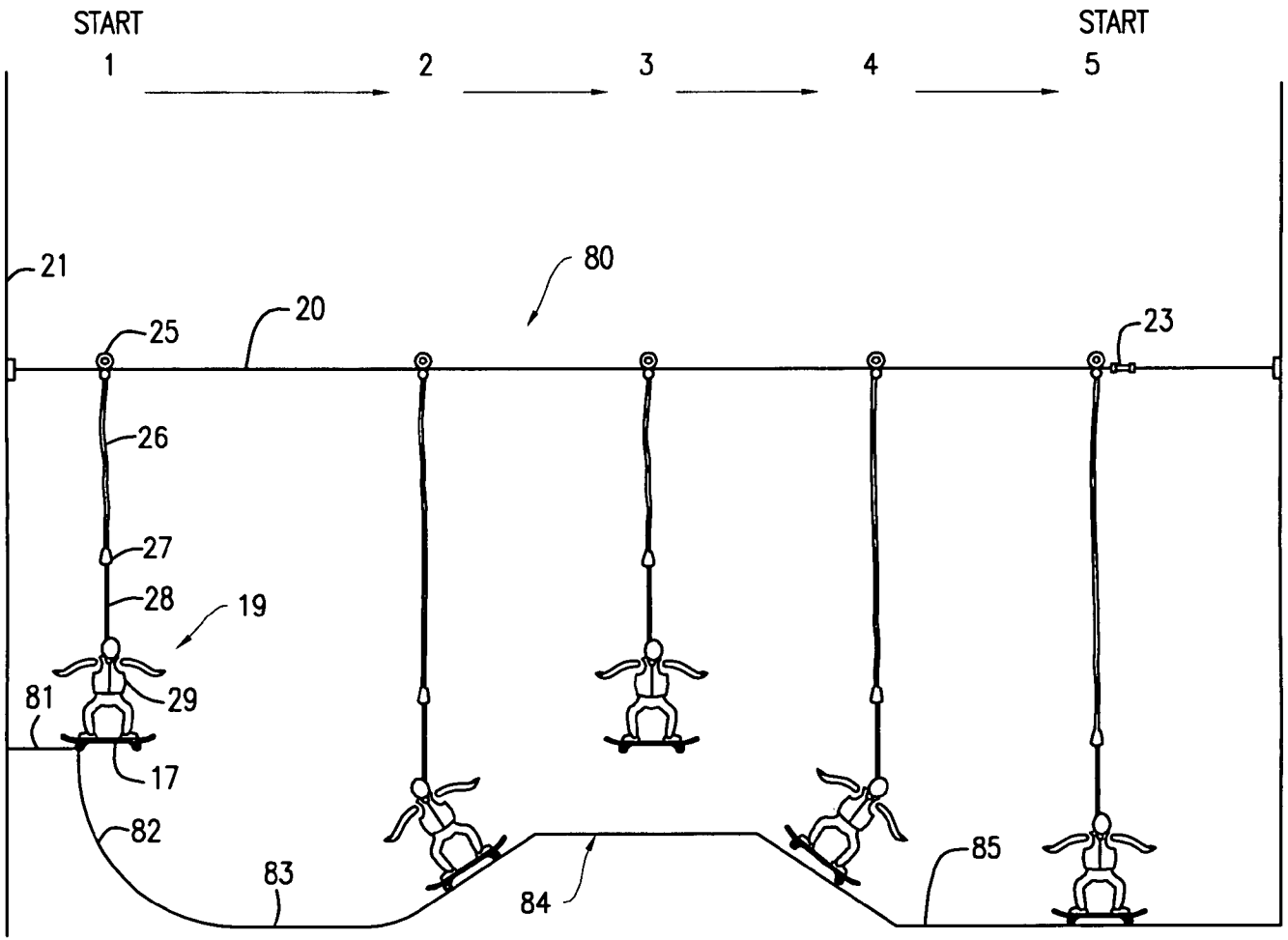
FIG. 5 depicts a linear course set up using a single track wherein a skateboard rider begins from a platform and rides through the course while attached to the safety system.
Figure 6:
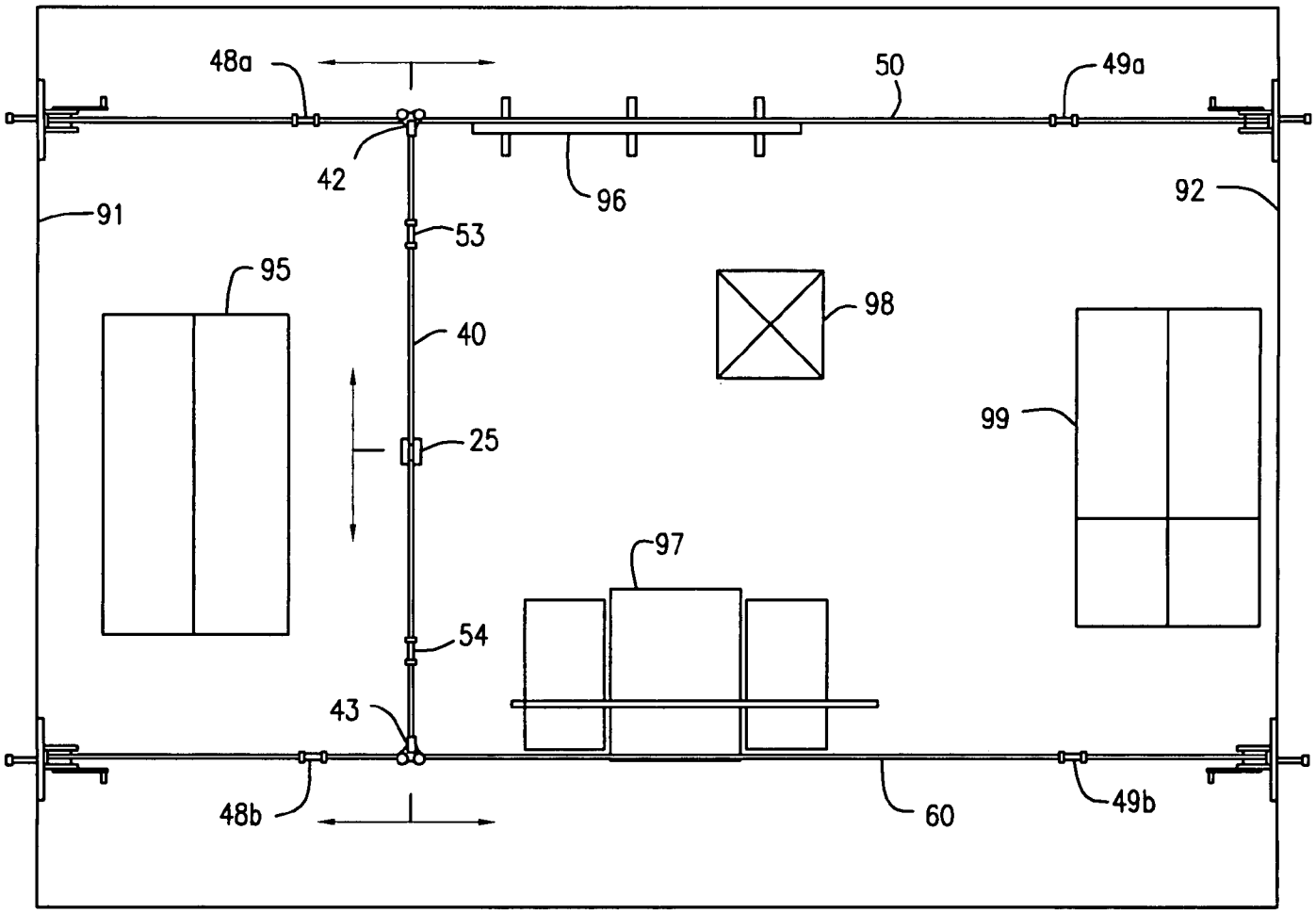

The full course set up relates to, for example, a skateboard park set up that is designed so that a street skater can practice a variety of tricks over a variety of obstacles. FIGS. 5 and 6 depict two embodiments of the system of the present invention being used on full course type set ups. In FIG. 5, track 20 is disposed above several obstacles, including a start deck 81, transition wall 82, flat base 83 and a jump 84. As depicted in this figure, track 20 traverses the entire length of these obstacles allowing the rider to move through the course without restrictions, but if he falls, the harness will keep him from hitting the ground and avoid the consequence of serious injury.

FIG. 6 is a view from above of an entire full course set up that could be found in a skateboard park with the safety system of the invention disposed thereabove. In this figure, track 40 is again disposed laterally over the course in between longitudinal tracks 50 and 60 that span both sides of the course lengthwise. Obstacles are places throughout the area covered by the system and the system is adapted to allow the rider to move laterally via track 40 and horizontally via tracks 50 and 60 in such a way that he can attack each obstacle freely. While there is no limitation to the number or types of obstacles that can be used, shown in this embodiment are a quartepipe 95, a rail 96, a table with a rail 97, a box wedge 98 and a double section quarterpipe 99.

Big Air Set Up

The big air system is designed to help riders (skateboard, snowboard, skier, bicycle, etc.) overcome the fear of jumping long distances way up in the air by having the rider attached to a track running above the jump. The rider can practice the enormous jumps required in big air competition, without risking injury from severe wipe outs which tend to occur often. Ultimately, the safety system of the invention allows riders to try "big air" tricks they never thought possible with the confidence that they won't get hurt from a severe fall.

Mobile Set-up

In another embodiment, the safety system of the invention can be in the form of a mobile half-pipe as depicted in FIGS.

Figure 7A:
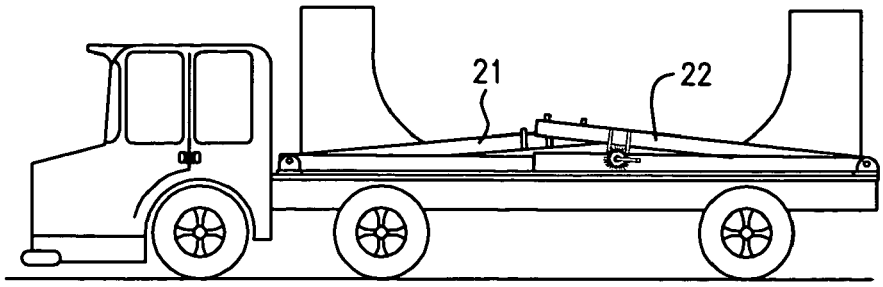
FIG. 7*a* depicts the mobile half-pipe safety system of the present invention in a folded/closed set up to allow for mobilization.
Figure 7B:
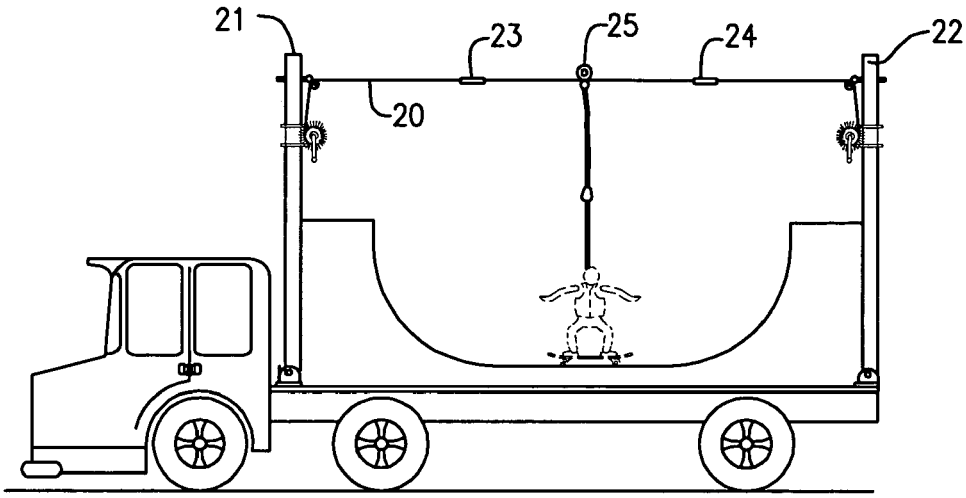
FIG. 7*b* depicts the mobile half-pipe system device of the present invention open and set up for use.
Figure 7C:
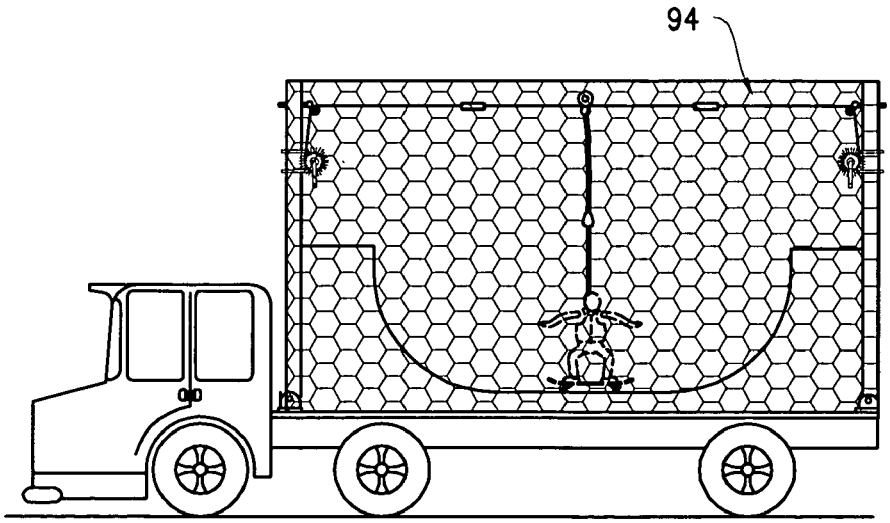
FIG. 7*c* depicts the mobile half-pipe safety system shown in FIG. 7*b* having a safety netting disposed around the system.

7A-7C. The mobile half pipe with the harness safety system is designed to be able to be mobilized to and from events, games. The system is made up of one or more vehicles, such as a truck with a bed, with either whole half pipe or sections of a half pipe that can be parked next to each other where the half pipes are then, for example, slid into place and bolted together. Further, contemplated in this embodiment is the use of safety netting as depicted in FIG. 7C. This embodiment provides the ability to use the system of the invention anywhere.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A half-pipe safety system comprising:

a. a half-pipe shaped surface comprising a flat base, and first and second transition walls, wherein the distance from the first transition wall to the second transition wall defines a width of said half-pipe, and wherein said half-pipe further comprises a length having a far end and a near end;

b. a first track disposed above said surface at about the far end of the half-pipe and extending horizontally from a position above said first transition wall to a position above said second transition wall;

c. a second track disposed above said surface at about the near end of the half-pipe and extending horizontally from a position above said first transition wall to a position above said second transition wall;

d. a third track extending laterally between said first track and said second track;

e. a first fastener disposed on said first track and adapted to ride freely along said first track and fixedly attached to a far end of said third track;

f. a second fastener disposed on said second track and adapted to ride freely along said second track and fixedly attached to a near end of said third track;

g. a third fastener disposed on said third track and adapted to ride freely along said third track;

h. a cord comprising a top end and a bottom end, wherein said top end is fixedly attached to said third fastener; and i. a harnessing apparatus fixedly attached to the bottom end of said cord.

2. The half-pipe safety system of claim 1 further comprising first and second stoppers movably disposed on said first track, said first stopper positioned between said first fastener and said position above the first transition wall, and said second stopper positioned between said first fastener and said position above the second transition wall, and each of said first and second stoppers adapted to be fixed in a predetermined position on said track, said safety system further comprising third and fourth stoppers movably disposed on said second track, said third stopper positioned between said second fastener and said position above the first transition wall, and said fourth stopper positioned between said second fastener and said position above the second transition wall, and each of said third and fourth stoppers adapted to be fixed in a predetermined position on said track.

3. The half-pipe safety system of claim 1 wherein said cord comprises a first cord having a top end and a bottom end, and a second cord having a top end and a bottom end, wherein the top end of the first cord is attached to the third fastener, the bottom end of the first cord is attached to the top end of the second cord, and the bottom end of the second cord is attached to the harness.

4. The half-pipe safety system of claim 3 wherein the bottom end of the first cord is attached to the top end of the second cord using a clip.

5. The half-pipe safety system of claim 3 wherein the first cord comprises a flexible material and the second cord comprises a stiff material.

6. A half-pipe safety system comprising:

a. a half-pipe shaped surface comprising a flat base, and first and second transition walls, wherein the distance from the first transition wall to the second transition wall defines a width of said half-pipe, and wherein said half-pipe further comprises a length having a far end and a near end;

b. a first track disposed above said half-pipe outside of the first transition wall and extending horizontally along the length of the half-pipe from the near end of the half-pipe to the far end of the half-pipe;

c. a second track disposed above said half-pipe outside of the second transition wall and extending horizontally along the length of the half-pipe from the near end of the half-pipe to the far end of the half-pipe;

d. a third track extending laterally between said first track and said second track;

e. a first fastener disposed on said first track and adapted to ride freely along said first track and fixedly attached to a first end of said third track;

f. a second fastener disposed on said second track and adapted to ride freely along said second track and fixedly attached to a second end of said third track;

g. a third fastener disposed on said third track and adapted to ride freely along said track;

h. a cord comprising a top end and a bottom end wherein said top end is fixedly attached to said third fastener; and i. a harnessing apparatus fixedly attached to the bottom end of said cord.

7. The half-pipe safety system of claim 6 further comprising first and second stoppers movably disposed on said third track, said first stopper positioned between said fastener and said position above the first transition wall, and said second stopper positioned between said fastener and said position above the second transition wall, and each of said first and second stoppers adapted to be fixed in a predetermined position on said track.

8. The half-pipe safety system of claim 6 wherein said cord comprises a first cord having a top end and a bottom end, and a second cord having a top end and a bottom end, wherein the top end of the first cord is attached to the fastener, the bottom end of the first cord is attached to the top end of the second cord, and the bottom end of the second cord is attached to the harness.

9. The half-pipe safety system of claim 8 wherein the bottom end of the first cord is attached to the top end of the second cord using a clip.

10. The half-pipe safety system of claim 8 wherein the first cord comprises a flexible material and the second cord comprises a stiff material.

* * * * *